US010780597B2

(12) United States Patent
Petersen

(10) Patent No.: US 10,780,597 B2
(45) Date of Patent: Sep. 22, 2020

(54) FINGER RAZOR

(71) Applicant: Christopher Petersen, Manassas, VA (US)

(72) Inventor: Christopher Petersen, Manassas, VA (US)

( * ) Notice: Subject to any disclaimer, the term of this patent is extended or adjusted under 35 U.S.C. 154(b) by 0 days.

(21) Appl. No.: 16/170,664

(22) Filed: Oct. 25, 2018

(65) Prior Publication Data

US 2020/0130210 A1 Apr. 30, 2020

(51) Int. Cl.
*B26B 21/52* (2006.01)
*B26B 21/02* (2006.01)

(52) U.S. Cl.
CPC ..... *B26B 21/527* (2013.01); *B26B 21/02* (2013.01); *B26B 21/525* (2013.01)

(58) Field of Classification Search
CPC ..... B26B 21/22; B26B 21/527; B26B 21/225; B26B 21/521; B26B 21/4081; B26B 21/06; B26B 21/522; B26B 21/222; B26B 21/08; B26B 21/525; B26B 21/443
USPC ..... 30/526, 34.05, 298, 34.1, 296.1, 340, 30/232, 47–51; 132/212; D8/98; D28/44–48
See application file for complete search history.

(56) References Cited

U.S. PATENT DOCUMENTS 1,917,812 A * 7/1933 Robinson ..... B26B 21/527 30/72
2,501,987 A * 3/1950 Brown ..... B26B 21/06 30/32
2,588,211 A * 3/1952 Crowell ..... B26B 21/16 30/64
4,712,300 A * 12/1987 Hemmeter ..... B26B 21/44 30/41
4,964,214 A * 10/1990 Welsh ..... B26B 21/20 30/49
5,357,680 A 10/1994 Monistere
D386,819 S 11/1997 Doyle
6,018,877 A 2/2000 Greene
6,029,356 A * 2/2000 Sprinkle ..... B26B 21/08 30/298
6,493,950 B1 * 12/2002 Kludjian ..... B26B 21/22 30/298
6,550,148 B2 4/2003 Cecil
7,162,800 B2 * 1/2007 Orloff ..... B26B 21/225 30/41
2003/0167644 A1 * 9/2003 Motta ..... B26B 21/165 30/526

(Continued)

FOREIGN PATENT DOCUMENTS

GB 2265105 A 9/1993
GB 2487915 A * 8/2012 ..... B26B 21/527
WO WO2012_107713 A1 8/2012

OTHER PUBLICATIONS

Long-Tran, "Shave with a Flick of a Finger," www.yankodesign.com/2011/01/20/ring-shaver, Jan. 20, 2011.

(Continued)

*Primary Examiner* — Ghassem Alie
(74) *Attorney, Agent, or Firm* — Bacon & Thomas, PLLC

(57) ABSTRACT

A fingertip shaver has a generally cylindrical shape and requires no extension or moving parts. The blade or multiple blades of the shaver are provided in a cartridge mounted within in an opening or recess formed in a flattened or truncated portion of the cylinder.

3 Claims, 1 Drawing Sheet

(56) References Cited

U.S. PATENT DOCUMENTS

| | | | | |
|---|---|---|---|---|
| 2011/0283540 | A1* | 11/2011 | Wetteroff | B26B 21/523 30/47 |
| 2015/0202783 | A1 | 7/2015 | Safar | |
| 2015/0290821 | A1* | 10/2015 | Manshoory | B26B 21/4037 30/41 |
| 2016/0151924 | A1* | 6/2016 | Gers-Barlag | B26B 21/522 30/34.05 |
| 2018/0117781 | A1* | 5/2018 | Gonterman | B26B 21/222 |

OTHER PUBLICATIONS

"Head Blade Sport razor with Triple Blade Technology for Men, Head Shave," www.amazon.com/headblade-sport-razor-triple-technology, downloaded Sep. 4, 2018.

* cited by examiner

FINGER RAZOR

BACKGROUND OF THE INVENTION

1. Field of the Invention

The invention relates to a shaving device that fits over a user's finger.

2. Description of Related Art

It has previously been proposed to provide a safety razor that can be gripped by, or mounted on, a user's fingers for convenience and shaving control. For example, U.S. Pat. No. 1,917,812, issued on Jul. 11, 1933, disclosed a safety razor pivotally mounted on a finger ring. More recently, U.S. Pat. Nos. 6,018,877; 5,357,680 and Des. 386,819, and U.K. Patent Publication No. 2,265,105 disclosed razors that are mounted on, or extend from, a ring or cylinder arranged to be fitted over one or more fingers; U.S. Pat. No. 6,550,148 described a razor that is held between the user's fingers; U.S. Patent Publication No. 2015/0202783 described a rotary blade razor arranged to be secured to a fingertip by adhesive, and International Patent Publication No. WO 2012/107713 described a razor secured to a flexible sleeve arranged to be fitted over multiple fingers. In addition, a fingertip razor fitted with a roller and a blade cartridge extension is listed for sale on the Amazon.com website at http://www[dot]amazon[dot]com/HeadBlade-Sport-Razor-Triple-Technology/ . . . , while a cylindrical fingertip razor with a rotating blade is described in a web flier at http://www[dot]yankodesign[dot]com/2011/01/20/ring-shaver/.

Despite the relatively long history of attempts to provide fingertip shavers, the previously-proposed fingertip shavers are all either relatively complicated and fragile, costly to manufacture, or difficult to use. This is especially true of ring or cylinder-mounted shavers in which the blade is included in a cartridge that extends from the ring. Such an extension structure adds to the complexity and cost of the razor, is vulnerable to breakage, and results in a shaver that is difficult to maneuver using just a finger because the geometry of the shaver makes it difficult to align the blade with the section of skin to be shaved, particularly when that section area is highly curved and not directly visible to the user, as is the case with the area under the user's chin.

As a result, there is a need for a fingertip razor that is less costly to manufacture, more reliable, and easier to use.

SUMMARY OF THE INVENTION

It is accordingly an objective of the invention to provide a fingertip razor that has a simple construction.

It is also an objective of the invention to provide a fingertip razor that is easy to use.

These objectives are achieved, in accordance with the principles of a preferred embodiment of the invention, by a fingertip shaver that is generally cylindrical in shape, and that requires no extension or moving parts. By "generally cylindrical" is meant a shape in which an axially extending portion of the exterior surface of the cylinder is truncated or recessed to form a surface that defines the cutting plane of the shaver. An inner diameter of the cylinder is slightly larger than a finger, so that the cylinder fits comfortably over the user's finger.

The blades of the shaver are mounted within the truncated or recessed portion of the cylinder and may include a single blade or multiple blades. The shaver may be used by both men and women, on any portion of the body that is desired to be shaved.

DETAILED DESCRIPTION OF THE PREFERRED EMBODIMENTS

Figure 1:
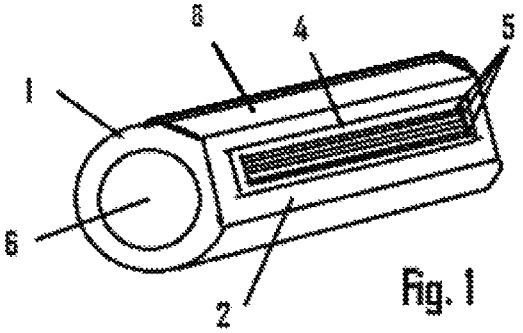
FIG. 1 is an isometric view of a fingertip shaver constructed in accordance with the principles of a preferred embodiment of the invention.
Figure 2A:
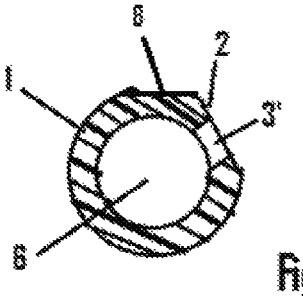
FIGS. 2A and 2B are cross-sectional side views of alternative constructions for the fingertip shaver of FIG. 1.
Figure 3:
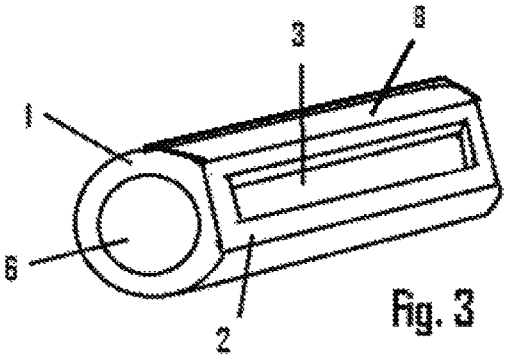
FIG. 3 is an isometric view of the fingertip shaver of FIG. 1, from which the blade assembly has been removed.

As illustrated in FIGS. 1-3, the preferred shaver includes a main body 1 in the shape of a longitudinally truncated cylinder, i.e., a cylinder in which a section 2 of the circumference is flattened, the flattened section 2 extending substantially the length of the cylinder in an axial direction parallel to the longitudinal axis of the cylinder.

Figure 2B:
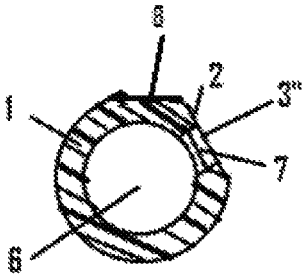

As illustrated in FIG. 3, the flattened section 2 of the main body 1 includes an opening 3, which may extend through the main body in a radial direction to form a parallelepiped-shaped opening 3', as shown in FIG. 2A, or which may only extend only part way through the main body to form a parallelepiped-shaped recess 3" with a flat bottom surface 7, as shown in FIG. 2B.

Mounted in the opening 3 is a blade assembly or cartridge 4 that includes one or more blades 5. The blade assembly or cartridge 4 may be similar to a conventional handle mounted razor blade cartridge, and may have as many as five or more of the blades 5, and a lubricant strip (not shown). The cartridge may be secured in the opening by an interference fit, an adhesive, a mechanical fastener, bracket, ultrasonic welding, or any other known attachment means or method. It is within the scope of the invention to mount the cartridge in such a way that it is replaceable, although the entire shaver could also be designed to be disposable after the blades have become dull.

Optionally, a second surface 8 of the main body 1 may also have a reduced curvature, and/or a longitudinally extending ridge or rib, so as to provide a comfortable rest for the finger or fingers that are outside the main body rather than placed in the opening 6. The shape and size of the optional second flattened surface 8 may be varied for comfort, and also located on different sides of the main body 1 to accommodate left and right handed users.

In order to use the finger shaver, the user extends a finger, such as the index finger, through the central opening 6 of the main body 1, with the blades 5 being positioned in such a way that they can be placed in contact with the area of the user's body or face that is to be shaved. The user then moves the shaver by moving the hand and/or finger in such a way that the blades pass over the skin and remove any hair in the path of the blade. The shaver may be used by either men or women, on any body part with hair. The diameter of the central opening 6 may be selected to be wide enough to comfortably fit a user's finger, without being too loose. Different diameters may be provided for men and women, and/or persons with different finger sizes.

The main body 1 may be made of any material, including lightweight inexpensive moldable plastic materials such as polyvinyl chloride, polypropylene, polyethylene, or polycarbonate materials.

Although a preferred embodiment of the present invention has been described in detail in connection with the appended drawings, it will be appreciated by those skilled in the art that details of the invention may be varied or modified without departing from the scope of the invention, and that the invention is to be limited solely by the appended claims. For example, instead of being dimensioned to fit over a single finger, the main body may be widened to accommodate more than one finger.

What is claimed is:

1. A fingertip razor, comprising a generally cylindrical main body having a first end and a second end, a through-hole extending from the first end to the second end of the body along a longitudinal axis of the body, the through-hole has an inner diameter sufficient to accommodate only a single finger of a user so that the main body is configured to securely fit over the single finger, wherein the cylindrical main body has a flattened section that forms a parallelepiped-shaped opening extending substantially a length of the main body in an axial direction of the cylinder, the opening further extending in a radial direction at least part way through the main body, wherein the opening entirely extending into the inner diameter; and a cartridge fitted into the opening and fixedly mounted to the generally cylindrical main body, the cartridge containing multiple razor blades at least partially positioned within the opening.

2. A fingertip razor as claimed in claim 1, the opening extends radially through the main body to an interior of the cylinder.

3. A fingertip razor as claimed in claim 1, wherein the main body is made of a plastic material.

* * * * *